US005450108A

United States Patent [19]

Drake et al.

[11] Patent Number: 5,450,108

[45] Date of Patent: Sep. 12, 1995

[54] INK JET PRINTHEAD WHICH AVOIDS EFFECTS OF UNWANTED FORMATIONS DEVELOPED DURING FABRICATION

[75] Inventors: Donald J. Drake, Rochester; Diane Atkinson, Webster, both of N.Y.

[73] Assignee: Xerox Corporation, Stamford, Conn.

[21] Appl. No.: 126,962

[22] Filed: Sep. 27, 1993

[51] Int. Cl.[6] ..... B41J 2/34

[52] U.S. Cl. ..... 347/65

[58] Field of Search ..... 347/63, 64, 65

[56] References Cited

U.S. PATENT DOCUMENTS

| | | | |
|---|---|---|---|
| Re. 32,572 | 1/1988 | Hawkins et al. | 156/626 |
| 4,601,777 | 7/1986 | Hawkins et al. | 347/63 |
| 4,638,337 | 1/1987 | Torpey | 346/140 R |
| 4,678,529 | 7/1987 | Drake et al. | 156/234 |
| 4,774,530 | 9/1988 | Hawkins | 346/140 R |
| 5,010,355 | 4/1991 | Hawkins et al. | 346/140 R |

*Primary Examiner*—Benjamin R. Fuller
*Assistant Examiner*—Valerie Ann Lund

[57] ABSTRACT

An improved thermal ink jet printhead is formed by the alignment and bonding of an anisotropically etched silicon wafer channel plate, containing a plurality of channel grooves, to a silicon wafer heater plate, containing a plurality of heating and addressing elements which are covered by a patterned thin and thick film insulating layer. The printhead enables better bonding of the two plates by sequentially patterning each layer of a two layer thick film layer to compensate for topographical features formed in the last thick film layer. The relative thickness and geometrical shapes of the recesses in the two layers are selected, so that topographic formations are varied to prevent standoff between bonded heater and channel plates, thereby insuring that the adhesive applied between the bonded plates will have the greatest propensity to bond.

3 Claims, 6 Drawing Sheets

INK JET PRINTHEAD WHICH AVOIDS EFFECTS OF UNWANTED FORMATIONS DEVELOPED DURING FABRICATION

BACKGROUND OF THE INVENTION

The present invention relates to a thermal ink jet printhead and method of manufacture therefor, and more particularly to an improved thermal ink jet printhead which avoids the effects of standoff between two bonded parts thereof caused by topographic formations developed during fabrication in a thick film insulating layer sandwiched between said two parts.

In existing thermal ink jet printing systems, an ink jet printhead expels ink droplets on demand by the selective application of a current pulse to a thermal energy generator, usually a resistor, located in capillary-filled, parallel ink channels a predetermined distance upstream from the channel nozzles or orifices. U.S. Pat. No. Re. 32,572 to Hawkins et al. exemplifies such a thermal ink jet printhead and several fabricating processes therefor. Each printhead is composed of two parts aligned and bonded together. One part is a substantially flat substrate which contains on the surface thereof a linear array of heating elements and addressing elements (heater plate), and the second part is a substrate having at least one recess anisotropically etched therein to serve as an ink supply manifold when the two parts are bonded together (channel plate). A linear array of parallel grooves are also formed in the second part, so that one end of the grooves communicate with the manifold recess and the other ends are open for use as ink droplet expelling nozzles. Many printheads can be made simultaneously by producing a plurality of sets of heating element arrays with their addressing elements on a silicon wafer and by mating a second silicon wafer having a corresponding plurality of sets of channel grooves and associated manifolds therein. After the two wafers are aligned and bonded together, the mated wafers are diced into many separate printheads.

Improvements to such two part thermal ink jet printheads include U.S. Pat. No. 4,638,337 to Torpey et al. that discloses an improved printhead similar to that of Hawkins et al., but has each of its heating elements located in a recess (termed heater pit). The recess walls containing the heating elements prevent lateral movement of the bubbles through the nozzle and, therefore, the sudden release of vaporized ink to the atmosphere, known as blow-out, which causes ingestion of air and interrupts the printhead operation whenever this event occurs. In this patent, a thick film insulative layer such as polyimide, Riston® or Vacrel® is formed on the wafer containing the heating element and patterned to provide the recesses for the heating elements, so that the thick film layer is interposed between the two wafers when they are mated together. U.S. Pat. No. 4,774,530 to Hawkins further refines the two part printhead by disclosing an improvement over the patent to Torpey et al. In this patent, further recesses (termed bypass pits) are patterned in the thick film layer to provide a flow path for the ink from the manifold to the channels by enabling the ink to flow around the closed ends of the channels, thereby eliminating the fabrication steps required to open the groove closed ends to the manifold recess. The heater plates, having the aforementioned improvements of heater pits and bypass pits formed in the thick film insulative layer covering the heater plate surface, are aligned with and bonded to the channel plate, so that each channel groove has a recessed heating element therein and a bypass pit to provide an ink passage from the ink manifold to the channel groove.

Thorough bonding between heater and channel plates is paramount to maintaining the printing efficiency, droplet size consistency, and operational reliability of an ink jet printhead. U.S. Pat. No. 4,678,529 to Drake et al. discloses a method of bonding ink jet printhead components together by spin coating or spraying a relatively thin, uniform layer of adhesive on a flexible substrate and then manually placing the flexible substrate surface with the adhesive layer against the channel wafer surface having the etched sets of channel grooves. A uniform pressure and temperature is applied to ensure adhesive contact with all coplanar surface portions and then the flexible substrate peeled away, leaving a uniformly thin coating on the channel wafer surface to be bonded to the heater wafer. This labor intensive method tends to permit adhesive layer thickness variation between wafer pairs as well as between different regions of the same wafer pair, so that after the wafer pairs are diced into a plurality of identical printheads, the ink flow characteristics varies from printhead to printhead. A more mechanized process to place the adhesive coating on the channel wafer without operator involvement and consequent variation in parameters which introduced thickness variations in the amount of adhesive layer transferred to the channel wafers, especially in the thickness variations from wafer-to-wafer, is described in U.S. patent application Ser. No. 07/888,220, to Narang et al., Filed May 26, 1992.

Although advances have improved the thickness uniformity of the adhesive layer which bonds the ink jet printhead heater and channel plates, insufficient adhesion between bonded heater and channel plates continues to cause a host of problems affecting printhead operation, such as, for example, different drop sizes between adjacent channels, because unwanted topographical protruding formations or lips are formed in the thick film layer during the patterning of the heater pits and bypass pits which prevent adequate contact between the channel wafer surface with the adhesive layer and the thick film layer on the heater wafer. Since increased adhesive layer thickness is not a practical solution because it tends to spread or wick into the channels, the inter-channel gaps between bonded heater and channel plates must be minimized in order to insure consistent printhead firing characteristics. As taught by the above identified U.S. patents, two wafers are bonded together after alignment for subsequent dicing into individual printheads. Each printhead part is formed individually on two separate substrates or wafers, where one contains heating elements and the other ink channels or passageways. The wafer containing the ink channels is silicon, and the channels are formed by an anisotropic etching process. The anisotropic or orientation dependent etching has been shown to be a high yielding process that produces very planar and highly precise channel plates. The other wafer containing the heating elements as well as heater addressing logic is covered by a thick film insulating layer in which heater and bypass pits are formed using photolithography. The thick film layer is preferably polyimide, because it is impervious to water, a major component of the printhead ink. However, one drawback with the polyimide material is its tendency to form unwanted topographical formations, such as raised edges or lips (1–3 microns high) at photoimaged edges. When bonding both heater and channel plates together, a standoff between the two plates is caused by the raised edges, which reduces the adhesiveness of the bond between the two plates and which cause the formation of inter-channel gaps.

Polyimide topography, such as raised edges or lips, are undesirable by-products resulting from photoimaged and cured heater pits and bypass pits or trenches on heater plates. The raised edges are polyimide topographical features that are formed at the edge of photoimaged areas that do not shrink during curing as would bulk (or centered) areas of the polyimide. Consequently, raised edges critically interfere with the mating and bonding of the heater and channel plates.

Another form of polyimide topography is encountered in the form of edge beads or raised areas at the edge of the wafer, when a layer of liquid polyimide is dispensed and spun onto a wafer. When the contact area on the wafer is incapable of spreading further due to the contact angle at the edge of the wafer, centripetal forces push the spinning liquid polyimide towards the outside of the wafer to form an edge bead. The edge bead on a 4 inch diameter wafer, for example, is on the order of 0.5 inch wide radially from the outer edge thereof and has a thickness several micrometers thicker than the rest of the polyimide layer. Such edge beads of polyimide prevent adequate bonding between the wafers. Edge beads can also cause printhead reliability problems, because of additional stress placed on the center area of the channel plate during heater and channel plated bonding may cause cracking. Edge beads, if removed from the edge of the heater wafers, cantilevers the channel plate at its outside edges and can again cause cracks to be formed in the outer peripheral area of the channel wafer. Such cracking in the channel wafer will degrade the reliability of the individual printheads after they have separated from the wafer pair.

Raised edges and edge beads, however, are not the only topographical formation created from photoimaged polyimide. Other topographical formations, such as wall sags or dips, compound the negative effects of raised edges by adding to the standoff between the bonded heater and channel plates. Wall dips are slumps in the polyimide walls between closely adjacent polyimide photoimaged pits. The polyimide sandwiched between the two wafers can form more than 2 microns of topographical variation, which does not allow the bonding adhesive, approximately 2 microns or less thick, to bridge or fill in the formation of inter-channel gaps. These inter-channel gaps can allow crosstalk between channels when drops are being ejected. As the patent '529 to Drake et al. teaches, care must be taken when applying adhesive in bonding the channel and heater plates so as to insure all surfaces in contact with the ink are free of adhesive, in order that the ink channels are not obstructed during operation.

One method of minimizing heater and channel plate standoff of printheads using a modified printhead fabrication sequence is disclosed in U.S. patent application Ser. No. 07/997,473, entitled "Ink Jet Printhead Having Compensation For Topographical Formations Developed During Fabrication", assigned to the same assignee as the present invention and filed on Dec. 28, 1992. The printhead enables better bonding of the two plates by compensating for raised lips or edges formed on the outside edge of opposing last pits in an array of pits located in the thick film layer that are created while photofabricating the pits in the insulating layer. The fabrication sequence compensates for the raised edges by including a non-functional straddling channel that nullifies the standoff created by the raised edge and a corresponding additional non-functional pit that positions the raised edge away from the functional channels and nozzles. Although this fabrication technique compensates for polyimide raised edges, it does not attempt to solve the problem of edge bead.

There continues to exist, therefore, a need to prevent the standoff between mated heater and channel plates caused by edge beads and without requiring extra non-functional, straddling channels or in drastically altering the fabrication sequence of the heater and channel plates.

SUMMARY OF THE INVENTION

It is an object of the invention to substantially prevent the standoff between bonded heater and channel plates of a printhead, with minimal impact to the existing fabrication sequence of the printhead.

It is another object of the invention to provide a more reliable printhead that avoids the effects of topographic formations in the thick film insulating layer without the need of non-functional, straddling channels.

It is yet another object of the invention to minimize the effect of edge beads that may cause damage to channel plates during channel and heater wafer bonding.

To achieve the foregoing and other objects, and to overcome the shortcomings discussed above, improvements to an ink jet printhead assembly are disclosed that prevent the standoff between the channel and heater plates of printheads, when the printheads are the type formed by the alignment and bonding of an anisotropically etched silicon channel wafer, containing a plurality of sets of arrays of channel grooves, to a heater wafer containing a plurality of sets of arrays of selectively addressable heating elements that are disposed in pits or recesses formed in the thick film insulating layer. Heater and channel wafer standoff is caused by topographic formations produced while either applying the thick film layer to the heater wafer or patterning it to form the photoimaged recesses (pits). The present invention provides a fabrication sequence that substantially avoids the topographic formations formed in the thick film insulating layer of the heater wafer of the printhead.

The fabrication sequence of the printhead heater wafer is modified, so that the thick film layer comprises two sequentially formed and patterned layers, the material of which is preferably polyimide. The first polyimide layer is a relatively thin film layer patterned for larger heater pits and bypass pits than is required and for removal of the wafer edge bead, so that the raised edges of the pits and the wafer edge bead in the second, thicker polyimide layer do not prevent proper mating and bonding of the heater and channel wafers. The thinner and thicker polyimide layers are applied in succession to the heater plate. The film polyimide layers are first sequentially spun onto the heater wafer and subsequently sequentially photoimaged and cured, with the thinner layer not necessitating a fully curing step. The thinner polyimide layer has photopatterned relief trenches that compensates for topographical features formed in the second thicker polyimide layer. The depth of the two layers is selected so that topographic formations of varying heights substantially eliminate standoff between bonded heater and channel plates and insures the adhesive applied between the bonded plates will have the greatest propensity to bond. Thus, the magnitude of topographical effects can be avoided or modulated by the relative thickness and the relative sizes of the recesses of the film polyimide layers. The resulting improved printhead prevents standoff between the channel and heater plates caused by topographic formations such as raised edges and edge beads, without the need for extra non-functional channels.

A more complete understanding of the present invention can be obtained by considering the following detailed description in conjunction with the accompanying drawings, wherein like index numerals indicate like parts.

BRIEF DESCRIPTION OF THE DRAWINGS

FIG. 1 is an enlarged, partially shown isometric view of a printhead incorporating the present invention.

DESCRIPTION OF THE PREFERRED EMBODIMENT

Figure 2:
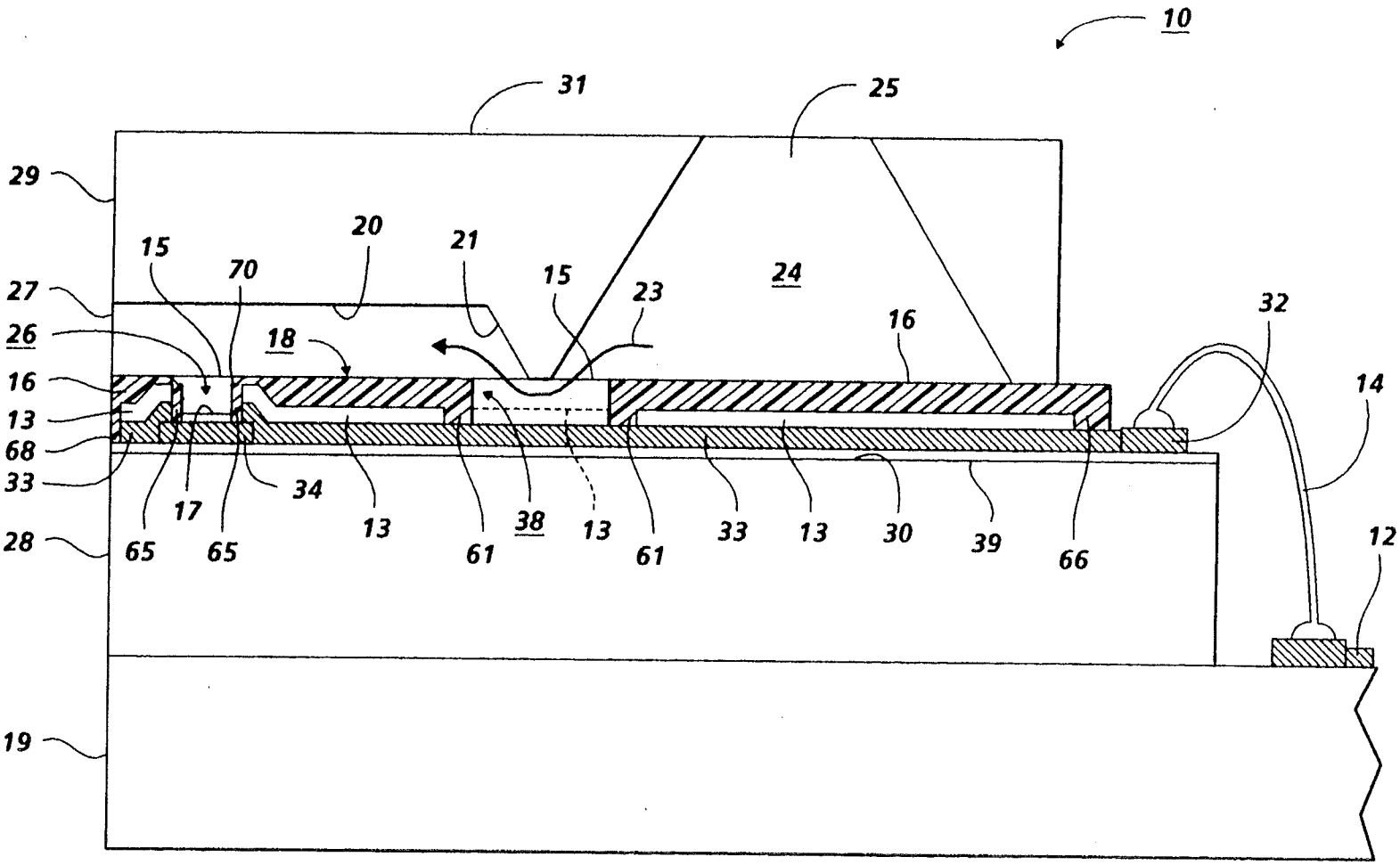
FIG. 2 is an enlarged cross-sectional view of FIG. 1 as viewed along the line 2—2 thereof.
Figure 3:
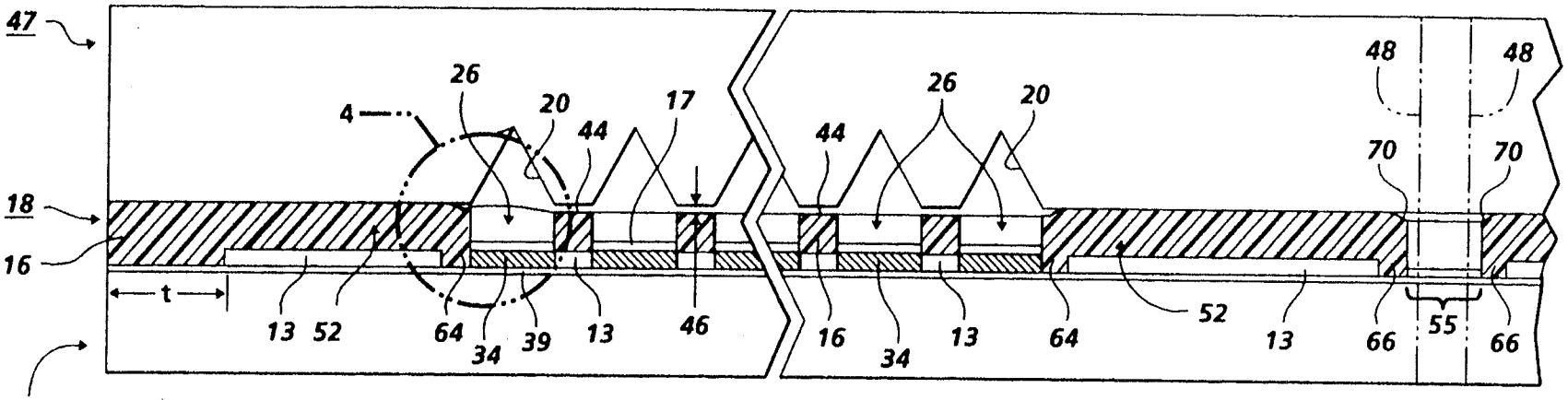
Figure 4:
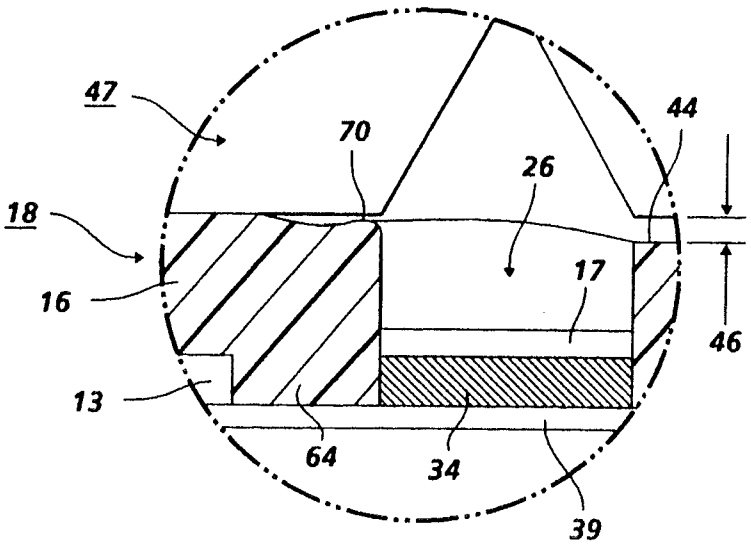

In FIG. 1, an enlarged, partially shown schematic isometric view of the printhead 10 incorporating the present invention is depicted, showing the front face 29 thereof containing the array of droplet emitting nozzles 27. FIG. 2 is a cross sectional view of FIG. 1 as viewed along line 2—2 taken through one of the ink channels 20, shown in dashed line. Also referring to FIG. 2, ink (not shown) flows from the manifold 24 and around the end 21 of the groove or ink channel 20, as depicted by arrow 23. The lower electrically insulating substrate or heating element plate 28 has the heating elements or resistors 34 and addressing elements 33 produced monolithically on underglaze insulating layer 39 formed on surface 30 thereof, while the upper substrate or channel plate 31 has parallel grooves 20 which extend in one direction and penetrate through the channel plate front face 29. The end of grooves 20 opposite the nozzles terminate at slanted wall 21. The through recess 24 is used as the ink supply manifold for the capillary filled ink channels 20 and has an open bottom 25 for use as an ink fill hole. The surface of the channel plate with the grooves are aligned and bonded to the heater plate 28, so that a respective one of the plurality of heating elements 34 is positioned in each channel 20, formed by the grooves and the lower substrate or heater plate. Ink under a slight negative pressure enters the manifold formed by the recess 24 and the lower substrate 28 through the fill hole 25 and, by capillary action, fills the channels 20 by flowing through a plurality of elongated recesses 38 formed in the thick film insulating layer 18, either one for each channel 20 or through a common trench-like recess that serves all of the channels. The ink at each nozzle forms a meniscus, the combination of negative ink pressure and surface tension of the meniscus prevents the ink from weeping therefrom.

As disclosed in U.S. Pat. No. Re. 32,572 to Hawkins et al., U.S. Pat. No. 5,010,355 to Hawkins et al., and U.S. Pat. No. 4,774,530 to Hawkins, all of which are incorporated herein by reference, thermal ink jet die or printheads 10 are generated in batches by aligning and adhesively bonding an anisotropically etched channel wafer 47 to a heater wafer 49 (FIG. 3) followed by a dicing step to separate the bonded wafers into individual printheads 10. Prior to forming the arrays of heating elements and addressing electrodes on one surface of the heater wafer (surface 30), an underglaze layer 39 is formed thereon, such as, silicon dioxide or silicon nitride. After the arrays of heating elements and addressing electrodes have been formed, a thin film passivation layer 45 of, for example, silicon nitride (shown only in FIG. 5) is deposited on the heater wafer surface 30 and over the heating elements and addressing elements to provide an ion barrier which will protect exposed electrodes from the ink. The passivation layer is cleared from the contact pads 32 and from the heating elements 34.

Figure 5:
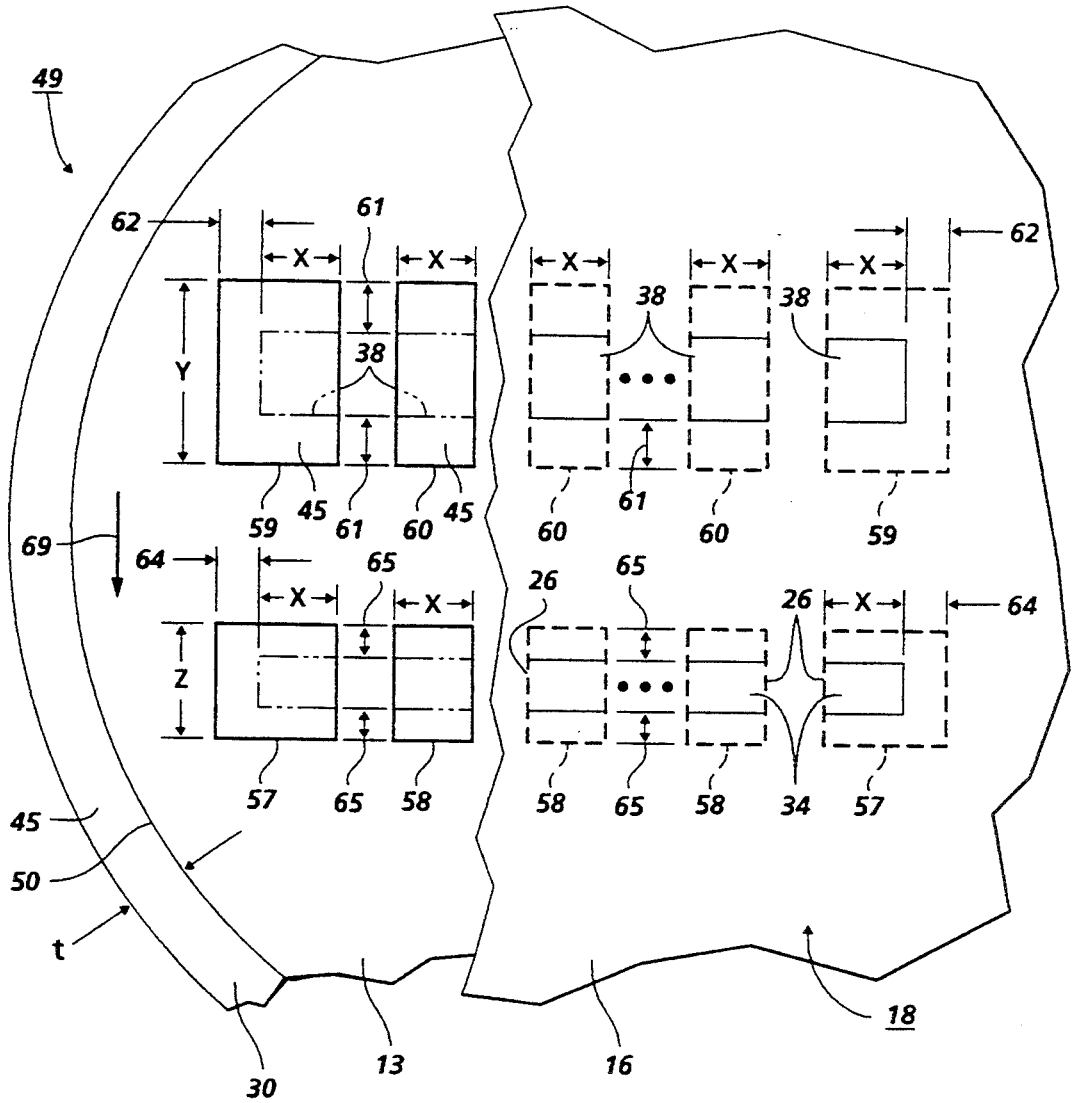
FIG. 5 is a partially shown top view of the heater wafer with a portion of the upper thick film insulative layer removed to show the lower, thinner insulative layer.

In this invention, the thick photopatternable layer 18 used for providing the heater pits 26 and bypass pits 38 comprises two layers; viz., a thinner, first layer 13 and a thicker, second overlaying layer 16. The preferred material for both first and second layers is polyimide. The thinner first polyimide layer 13 has etched therein relief trenches 57, 58, 59 and 60 having predetermined dimensions, as shown in FIG. 5, a plan view of a partially shown heater wafer 49 with a portion of the second, overlaying layer 16 removed to show some of the relief trenches 57–60, the rest of the relief trenches in the first layer is being shown in dashed line and discussed in detail later. As will become apparent, these relief trenches 57–60 compensate for the polyimide topographical features formed by the second, thicker, overlaying polyimide layer 16. The thicker second layer 16 of photopatternable material, preferably polyimide, is deposited over the patterned first polyimide layer 13, which was previously formed over passivation layer 45 and is exposed through the trenches 57–60 and at the wafer edge. The thin polyimide layer 13 is patterned to expose the heating elements, thereby placing the heating elements in separate pits 26, to clear the electrode terminals 32, and to remove the first polyimide film layer at locations which will subsequently provide ink flow bypass recesses 38 between the reservoir 24 and the ink channels 20, as well as to remove an outer annular ring of thin polyimide layer 13, so that the outer periphery 50 of polyimide layer 13 is shortened from that of the wafer 49 by the distance "t", generally about 0.5 inch for a four inch wafer. Optionally, the thin polyimide layer 13 is not patterned at the bypass recesses 38 (as shown in FIG. 2 in dashed line), since the upstream and downstream ends of the bypass recesses or pits, relative to the direction of the nozzles as indicated by arrow 69, (FIG. 5), are located within the channels 20 or the manifold 24. Thus, raised edges or lips on the upstream and downstream ends of the bypass recesses are not a stand off problem. In addition, the thin polyimide layer 13, when not patterned, provides an extra passivation for the electrodes or circuitry in this region. However, the opposing outer sides of the bypass recesses 38 do produce raised edges which may be avoided by patterning only recesses (not shown) in this location having width of dimension 62 and length of the bypass pit 38.

The heating elements are covered by protective layer 17, such as tantalum (Ta), to prevent cavitational damage to the heating elements caused by the collapsing vapor bubbles, but this Ta layer is not shown in FIG. 5 for sake of clarity. The printheads can be mounted on daughterboards 19 (See FIGS. 1 and 2) and electrically connected to electrodes 12 thereon by wire bonds 14. The daughterboard provides the interface with the printer controller (not shown) and power supplies (not shown).

Figure 6:
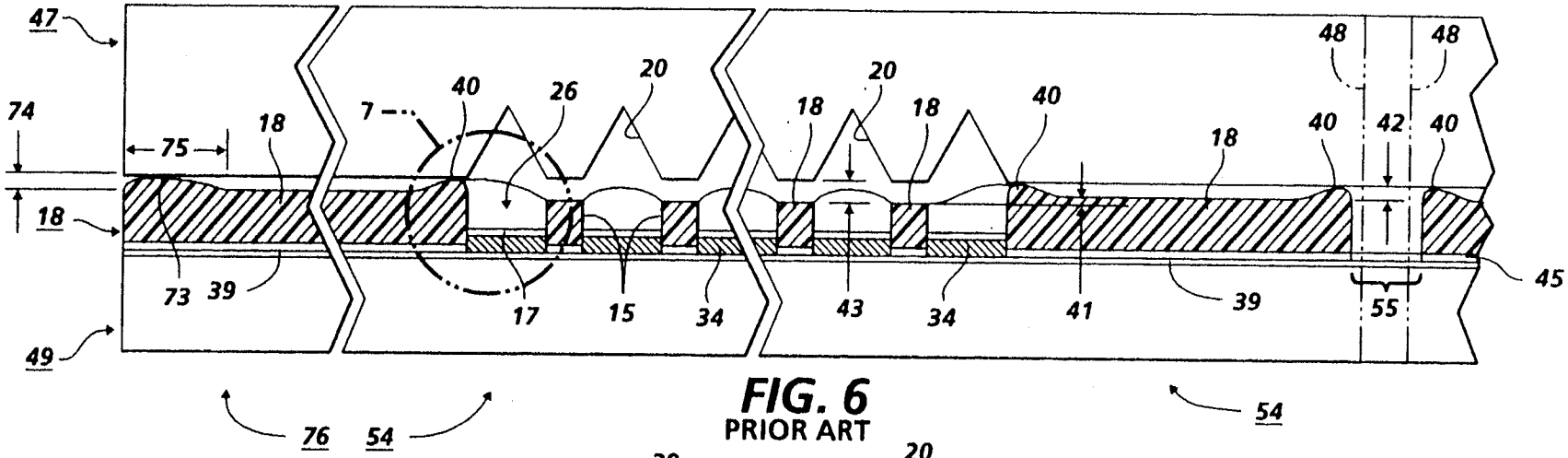
FIG. 6 PRIOR ART
FIG. 6 is an enlarged cross-sectional view of a portion of a typical prior art bonded channel wafer and heater plates similar to that shown in FIG. 3.
Figure 7:
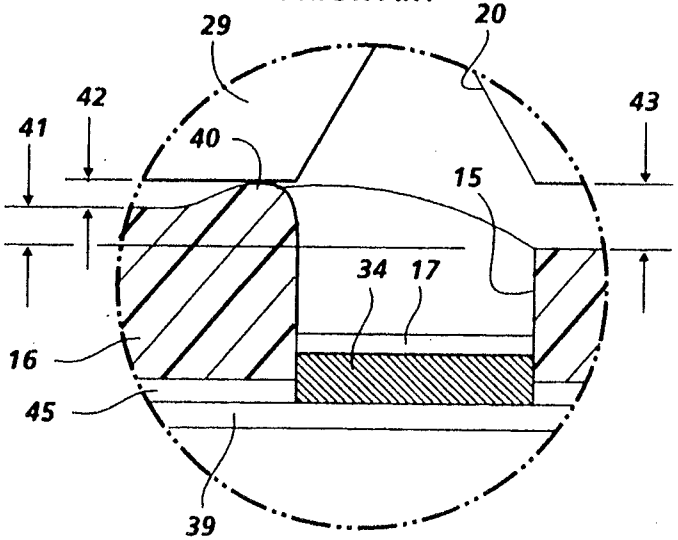
FIG. 7 PRIOR ART
FIG. 7 is an enlarged view of the area identified in FIG. 6 by circle 7.
Figure 8:
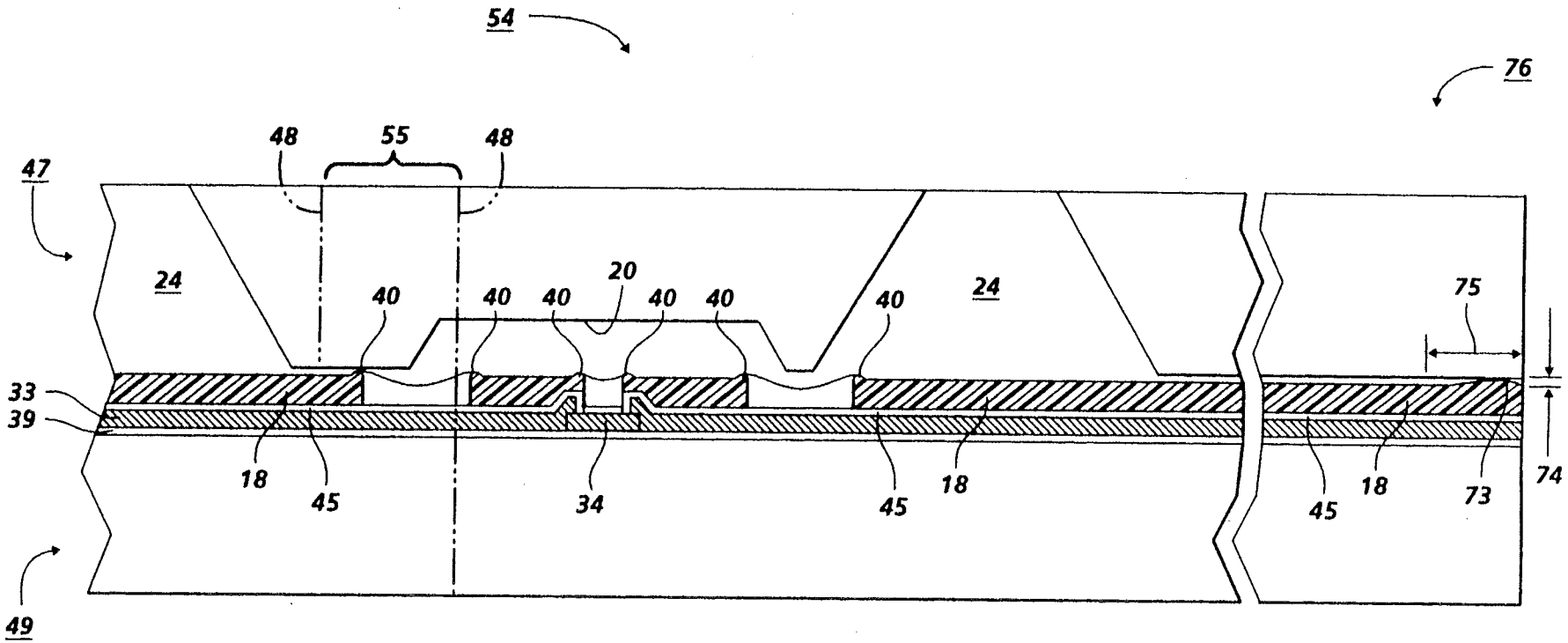
FIG. 8 PRIOR ART
FIG. 8 is an enlarged cross-sectional view of a portion of a typical prior art bonded wafer pair.

Referring to prior art FIGS. 6–8, where FIG. 6 shows a cross-sectional view of wafer pair 54 with the cross-section being perpendicular to the channels 20, and FIG. 8 shows a cross-sectional view of the wafer pair with the cross-section being taken parallel to and through one of the channels 20. FIG. 7 is an enlarged view of the area circled in FIG. 6 by circle 7. Topographic formations, as discussed in the background, are formed when heater pits 26 are photolithographically processed in a single thick film insulating layer 18 on heater wafer 49 opposing channel wafer 47 of wafer pair 54. These formations on the outer opposing pits in the array have the negative quality of increasing the standoff between channel wafer 47 and heater wafer 49. A first topographic formation formed while curing the photoimaged polyimide is raised edge or lip 40 which attributes to heater and channel plate standoff as indicated by spacing 42 in FIG. 7. Raised edge 40 is formed in polyimide thick film layer 18 on the outer sides of the outer heater pits 26 and outer sides of the bypass pits 38, as well as in the front and back of each of the heater and bypass pits. Lips 40 are formed at any edge of a large area of polyimide, such as for recesses 55 formed for die cuts 48 shown in FIG. 6. The plate standoff caused by the lips formed to the front and back of the pits has negligible affects because the channels 20 and manifolds 24 straddle them. A second topographic formation is a sag or dip in wall 15 between the pits as indicated by spacing 41 in FIG. 7. Sag is caused by the narrow width of polyimide between recesses, such as that formed between heater and bypass pits. The combination of the two resulting topographical formations of raised lip and wall sag cause a spacing or gap 43 equal to both the sag spacing 41 and the raised lip spacing 42 in the vicinity of walls 15. Walls 15 represent the separation between heater pits and between bypass recesses. This large gap 43 is responsible for promoting inter-channel cross talk or ink flow between channels that undermines the operational consistency of printhead 10.

A third topographic formation is edge bead 73, that is not a function of the photopatterning process for polyimides, but rather a function of centripetal forces incurred while spin forming the fluid polyimide layer 18 on the heater wafer 49. At the edge portion 76 of waver 49, the edge bead 73 is held on the wafer by surface tension. The polyimide is applied to the wafer 49 as a vicious liquid and spun until covering the wafer. Typically, the width of the edge bead 73 is on the order of 0.5 inch, as indicated by the distance 75.

In summary, the patterning or etching of recesses in a single polyimide layer such as, for example, heater and bypass pits of FIGS. 6–8, cause raised lips or edges at the edges of the recesses, whenever the recess edge was adjacent a relatively large area of unpatterned polyimide layer. On the other hand, when adjacent pits were relatively close together and the wall of polyimide material separating the pits or recesses was relatively thin, the polyimide wall would sag. Thus, the walls of polyimide between the heater and bypass pits would generally sag, while the upstream and downstream edges of the pits relative to the subsequent nozzle location would develop raised lips. Also, the outer edges of the outer pits in each array of heater and bypass pits developed raised lips. These raised lips and sagging walls resulted in a standoff or separation between the channel and heater wafers, which prevented satisfactory bonding thereof.

Referring to FIG. 5, the two-layer, thick film insulative layer 18, preferably polyimide, is formed on the heater wafer after the plurality of arrays of heating elements 34 and addressing electrodes (not shown) are formed, passivated by passivation layer 45, preferably silicon nitride, and the heating elements and contact pads are cleared of the passivation layer. First, a relatively thin layer 13 of polyimide is spun coated over the heating elements and electrodes to form a layer having a thickness of about 10 μm. As explained before, an annular edge bead is formed at the outer periphery of the wafer 49. For a wafer of about four inches, the edge bead's radial width "t" is about 0.5 inches. Next, the thin polyimide layer 13 is photoimaged, developed, and cured to form recesses over the heating elements 34, recesses for bypass pits 38, and to remove the annular edge bead. In one embodiment, as indicated above, the bypass pits in the thin polyimide layer 13 is omitted, in order to provide extra passivation of the underlying electrodes or circuitry. In this embodiment, small recesses adjacent the outer edges of the opposing outermost bypass recess locations are patterned (not shown). These small recesses in polyimide layer 13 are subsequently covered by the second thicker polyimide layer 16. These areas are not patterned in polyimide layer 16, so that the underlying electrodes or circuitry remain covered by the thicker polyimide layer 16, yet any raised lip would not extend above the thicker polyimide layer covering the thinner polyimide layer 13 because of the small recesses (not shown) in the thinner polyimide layer 13 adjacent the outer edges of the outermost bypass recesses or pits 38. The thin polyimide layer is removed from the outer edge of the water to expose an annular ring of passivation layer 45 having a radial width of about 0.5 inches. The pits for the outer heating element in each array and the outer bypass pit would normally have raised edges of 1 to 3 μm, when the polyimide is in the 35 to 50 μm thickness range, the thickness required for the prevention of lateral movement of the droplet ejecting bubbles. However, the raised edges or lips in a 2 to 10 μm thick polyimide layer is less significant. The upstream and downstream ends of the prior art pits relative to the subsequent nozzle location also have raised edges, but these raised edges generally do not interfere with bonding of the channel and heater wafers because the channels straddle the heater pits and the raised edges on the downstream ends of the bypass pits. The other ends of the bypass pits are in the large through recess 24 (See FIG. 8). A second layer 16 of polyimide is spin coated over the patterned first, thin layer 13. The thickness of polyimide layer 16 is about 20 to 35 μm. While polyimide tends to be a leveling layer, i.e., it tends to smooth out the effects of the underlying topography, it has some conformal tendency as well, so that it tends to dip over low topographical areas. Thus, if the lower layer is removed from the region where an edge must be photoimaged (with the tendency to form a raised lip or edge), the upper layer will spin on such that the thickness of the upper layer alone is somewhat thinner than in areas that have both upper and lower layers. The recesses in the first polyimide layer 13 is larger than the final heater and bypass recesses where raised lips will form by about 65 μm, so that the raised lips formed in the second polyimide layer 16 will not exceed the height of the combined first and second polyimide layers 13 and 16.

The width of the recesses 57, 59 in the first polyimide layer 13 for the outer heater pits and bypass pits, respectively, are extended beyond the normal or final width size of the pits as indicated by dimension "X". The increased size is indicated by the dimension 64 and 62 for the heater pits and bypass pits, respectively, so that the overall width is X+dimension 64 for the outer heater pits over the heating elements 34 and the overall width is X+dimension 62 for the outer bypass pits. The length of the heater pits is increased by the dimension 65 on the upstream and downstream ends, so that the overall length is "Z". The length of the bypass pits is increased by the dimension 61 on the upstream and downstream ends, as indicated by arrow 69 which represents the direction toward the nozzles, so that the overall length is "Y". The recesses 58 for the heater pits are intermediate the outer opposing recesses 57 and have only the upstream and downstream ends increased by the dimension 65, so that the widths are unchanged from X, the actual width of the final pit sizes. Thus overall lengths are "Z" which are the length of the respective pits plus dimension 65. In the preferred embodiment, the increase in size of the recesses 57–60 over the final pit geometrical size is indicated by the dimensions 61, 62, 64 and 65, all of which are equal to about 65 μm.

After the first polyimide layer 13, having a thickness of 2 to 10 μm and preferably 3 μm, has been patterned and cured, a second polyimide layer 16 is spin coated thereover to a thickness of about 20 to 35 μm and preferably 32 μm. Because the outer ring of polyimide layer 13 has been removed, the edge bead formed by the second polyimide layer 16 will not have a height or thickness significantly greater than the combined thickness of the first and second polyimide layers. Thus, the edge bead problem is eliminated. As indicated above, the second polyimide layer tends to level, but is conformal enough to follow the topography of the first polyimide layer 13 and have a thickness in the recesses 57–60 that is less than the combined thickness of both polyimide layers. The second polyimide layer is patterned to the exact size needed for both the heater pits 26 and bypass pits 38. Since the thickness of the second polyimide layer is less than the combined thickness of both polyimide layers, the raised edges do not extend above the combined layers and the raised edge problem disappears, as more clearly shown in FIG. 4. The sagging of the walls 44 between the pits are reduced. The first polyimide layer 13 is cured prior to the application of the second polyimide layer 16, which, because of the leveling tendency of the second layer, will be slightly thicker over the walls 44 dividing the pits. Since the second polyimide layer is less thick than the single prior art thick film layer, the sag is also less. Since the raised edges do not extend above the plane of the two thick film layers, the only gaps between the channel wafer and the heater wafer are the sags in the walls 44 between the heater and bypass pits. The walls 44 are intermediate the outer pits in each array of heater and bypass pits. The sag without the raised edges are not a problem to satisfactory bonding of the wafers because the thickness of the adhesive layer on the channel wafer (not shown) is equal to or more than the gap 46 caused by the sagging pit walls 44.

Figure 3:
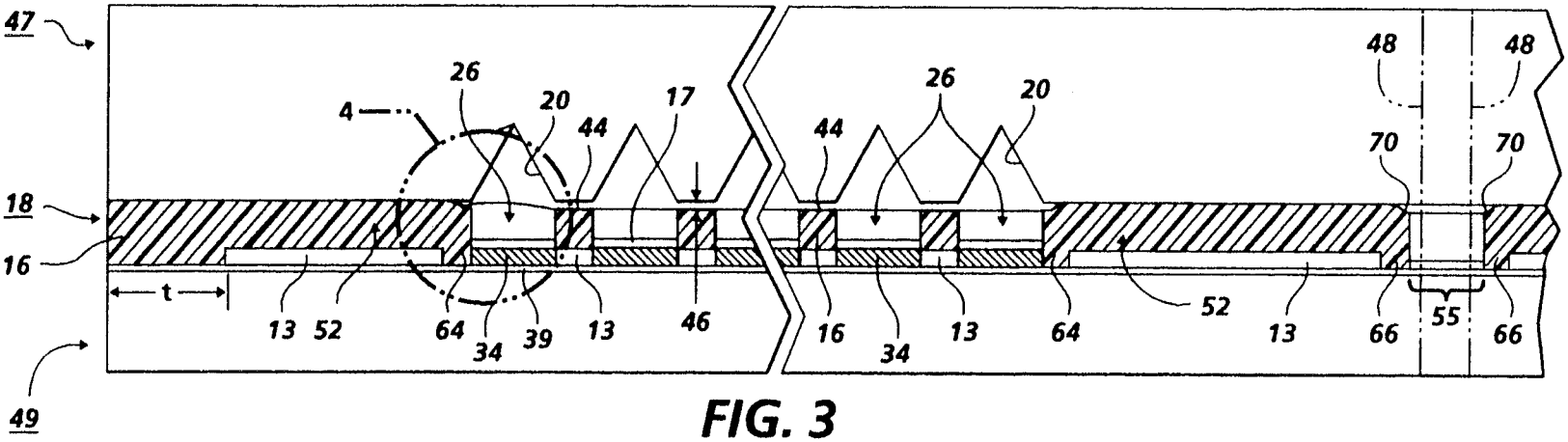
FIG. 3 is a cross-sectional front view of a portion of an aligned and adhesively bonded channel wafer and heater wafer.
Figure 4:
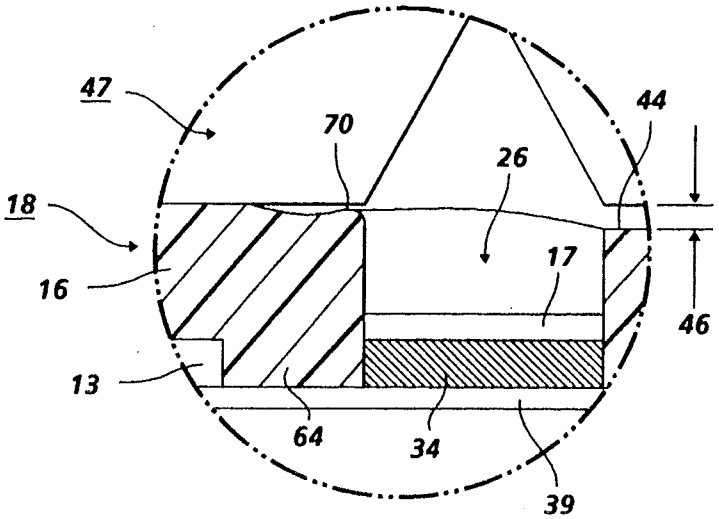
FIG. 4 is an enlarged view of the area identified in FIG. 3 by circle 4.

FIG. 3 is a cross-sectional front view of a portion of an aligned and adhesively bonded channel wafer 47 and heater wafer 49 prior to separation into a plurality of individual thermal ink jet printheads, one of which is shown in FIG. 1. FIG. 4 is an enlarged cross-sectional view of one of the channels 20 in FIG. 3 and identified by circle 4. FIG. 4 shows the raised edge or lip 70 formed on the outer edge of the heater pit 26 during the etching of the second polyimide layer 16. Also shown is the gap 46 between the channel wafer 47 and the second polyimide layer 16 which covers the thinner first polyimide layer 13 at the interface between the wall 44 formed between heater pits 26. The gap is caused by sag in the wall 44 between heater pits. If the bypass pits are formed for each channel, then similar walls with similar sags will be present. Since the first polyimide layer 13 is patterned to form recesses therein, the outer edges of these recesses are spaced from the outer heating element 34 in an array of heating elements by the distance 64. The second polyimide layer 16 which covers the thinner first polyimide layer 13, will be lower in the region of the recesses in polyimide layer 13 and the raised edge 70, formed when the heater pits 26 and bypass pits 38 are patterned in the second polyimide layer 16, will be slightly less than the height of the combined layers 13, 16. Therefore, there will be no standoff or separation of the heater and channel wafers caused by raised edges or lips as in the prior art printheads shown in FIG. 7. FIG. 3 shows that the removal of the edge bead, formed during the spin coating of the first polyimide layer 13, provides vertical space at the wafer outer periphery represented by the distance t for an edge bead that will only rise to substantially the same height as the combined thickness of the two polyimide layers 13, 16. Trench recesses 55 in the polyimide layer for accommodating dicing cuts 48 and clearance of contact pads 32 would ordinarily form raised lips, but using the same approach for these trench recesses 55 as is used for the heater pits and bypass pits, the first thin polyimide layer 13 is patterned larger than the final trench recess by the distance 66 therearound, so that the patterning of the desired size trench recess in the second, thicker polyimide layer 16 provides lips 70 which also do not extend above the combined polyimide layers 13, 16. Therefore, raised lips, which would cause a standoff between the heater and channel wafers is prevented.

Many modifications and variations are apparent from the foregoing description of the invention, and all such modifications are variations intended to be within the scope of the present invention.

We claim:

1. An improved ink jet printhead having a silicon upper substrate in which one surface thereof is anisotropically etched to form a set of parallel grooves for use as a linear array of ink channels for providing communication between an ink supply manifold and droplet ejecting nozzles of said printhead, and further having a lower substrate in which one surface thereof has an array of heating elements and addressing elements formed thereon, the upper substrate and the lower substrate being aligned, mated and bonded together to form the printhead, wherein the improvement comprises:

a thin film insulating layer being deposited on the lower substrate over the heating elements and the addressing elements and patterned to define therein a predetermined array of relief trenches; and a thick film insulating layer being deposited and patterned over said thin film insulating layer and array of relief trenches, said thick film layer, following depositing, patterning, and curing, form recesses therethrough, the recesses forming arrays of heater pits and channel bypass recesses to correspond with the droplet ejecting nozzles and heating elements, and wherein the thick film insulating layer overlying the relief trenches defines a height less than a combined height of the thin film insulating layer and the thick film insulating layer, thereby eliminating raised lips or edges which would interfere with the bonding of the lower substrate with the upper substrate.

2. The printhead of claim 1, wherein said thin film insulating layer and said thick film insulating layer are polyimide.

3. The printhead of claim 2, wherein the thin polyimide layer is patterned at an edge of the layer to remove an annular portion, so that the subsequently deposited thick polyimide layer will not form an edge bead.

* * * * *